US008279132B2

(12) United States Patent
Jung et al.

(10) Patent No.: US 8,279,132 B2
(45) Date of Patent: Oct. 2, 2012

(54) MULTI-MODE ANTENNA AND METHOD OF CONTROLLING MODE OF THE ANTENNA

(75) Inventors: Young-Bae Jung, Daejeon (KR); Soon-Young Eom, Daejeon (KR); Soon-Ik Jeon, Daejeon (KR); Chang-Joo Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 505 days.

(21) Appl. No.: 12/529,901

(22) PCT Filed: Mar. 5, 2008

(86) PCT No.: PCT/KR2008/001244

§ 371 (c)(1),
(2), (4) Date: Sep. 3, 2009

(87) PCT Pub. No.: WO2008/126985

PCT Pub. Date: Oct. 23, 2008

(65) Prior Publication Data

US 2010/0117913 A1 May 13, 2010

(30) Foreign Application Priority Data

Apr. 11, 2007 (KR) ..... 10-2007-0035724
Aug. 10, 2007 (KR) ..... 10-2007-0080590

(51) Int. Cl.
*H01Q 21/00* (2006.01)
*H01Q 3/24* (2006.01)

(52) U.S. Cl. ..... 343/853; 343/876

(58) Field of Classification Search ..... 343/853, 343/724, 876; 455/69, 561, 562, 442, 272; 375/222, 260, 295, 340, 347
See application file for complete search history.

(56) References Cited

U.S. PATENT DOCUMENTS 7,113,748 B2 * 9/2006 Shapira et al. ..... 455/63.4
7,260,141 B2 * 8/2007 Bierly et al. ..... 375/222
7,542,725 B2 * 6/2009 Ishida ..... 455/69

FOREIGN PATENT DOCUMENTS

JP 10093321 A 4/1998
KR 20050041243 A 5/2005
WO WO-9955012 A2 10/1999
WO WO-2005065122 A2 7/2005

* cited by examiner

*Primary Examiner* — Hoang V Nguyen
(74) *Attorney, Agent, or Firm* — Rabin & Berdo, P.C.

(57) ABSTRACT

Provided is an antenna for a base station and a repeater capable of electrically or mechanically controlling the individual operation of an element antenna constituting an array antenna or a sub-array antenna so as to adaptively cope with the change in the communication environment, and having an economic and high performance transmitting and receiving function, and a method of controlling a mode of the antenna. The multi-mode antenna includes a radiation portion having one or more array antenna and capable of selectively changing an antenna effective opening surface and changing a resistance direction of an antenna beam pattern, an active channel portion connected to the array antennas and including switches, transmission and receiving channels, and a signal combiner and splitter, and a modem and control portion connected to the active channel portion and having a control portion and a modem.

17 Claims, 12 Drawing Sheets

MULTI-MODE ANTENNA AND METHOD OF CONTROLLING MODE OF THE ANTENNA

TECHNICAL FIELD

The present invention relates to an antenna, and more particularly, to a reconstructed antenna for a base station and a repeater used for mobile communications. The present invention is derived from a research project supported by the Information Technology (IT) Research & Development (R&D) program of the Ministry of Information and Communication (MIC) [2007-F-041-01, Intelligent Antenna Technology Development].

BACKGROUND ART

In mobile communication, multi-antenna communication technology refers to a technology of performing modem signal processing using two or more antennas. A need for not only a multimedia communication service requiring a high quality and a very high capacity but also a high quality voice service similar to or higher than a wired communication voice quality is increasing. A core technology expected to satisfy such requirements is multi-antenna communication technology.

Multi-antenna communication technology can be divided into three types: a beam forming technology, a diversity technology, and a multiplexing technology. Beam forming technology improves performance by removing surrounding interference by adjusting phase information for each antenna to control signal strength according to the position angle between a base station and a user. Diversity technology improves performance by setting a predetermined distance between antennas to allow the antennas to independently transmit signals. A typical example of the diversity technology is a multiple input multiple output (MIMO) antenna. Multiplexing technology is a technology for transmitting different data to each of a plurality of antennas, and is used to improve the maximum transfer speed.

FIG. 1 illustrates the structure of a conventional base station antenna. Referring to FIG. 1, the conventional base station antenna includes an array antenna 10 for transmitting or receiving signals, an active portion 20 for managing amplification of a power signal, and a modem portion 30 for supplying a signal in a base band or RF band to the active portion 20 and modulating and demodulating signals.

However, since the operation of each of a plurality of element antennas 12 or a sub-array antenna constituting the array antenna 10 cannot be separately controlled, the array antenna 10 does not have a reconstruction function to control an effective opening surface of the array antenna 10 and a function to control the steering of an antenna beam. Also, since transmitting and receiving functions cannot be selectively switched, the efficiency of the array antenna 10 is low.

Therefore, for an existing base station antenna, in terms of communication, an adaptive response to a change in communication environment such as an increase or a decrease in the number of subscribers in an area after the initial installation is not possible. Also, a conventional array antenna as illustrated in FIG. 1 is not appropriate for a next generation communication environment in which a MIMO antenna is required.

DISCLOSURE OF INVENTION

Technical Problem

To solve the above and/or other problems, the present invention provides an antenna for a base station and a repeater capable of electrically or mechanically controlling the individual operation of each of a plurality of element antennas constituting an array antenna or a sub-array antenna so as to adaptively cope with changes in a communication environment, and having an economic and high performance transmitting and receiving function, and a method of controlling a mode of the antenna.

Technical Solution

According to an aspect of the present invention, a multi-mode antenna comprises: a radiation unit having one or more array antennas and capable of selectively changing an antenna effective opening surface and changing a resistance direction of an antenna beam pattern; an active channel unit connected to the array antennas of the radiation unit, comprising a plurality of switches, a plurality of transmission channels, a plurality receiving channels, and a signal combiner and splitter; and a modem and control unit connected to the active channel unit and having a control unit and a modem. Thus, a multi-mode antenna capable of actively changing a service area of a base station and a repeater according to the communication environment is provided.

Each of the array antennas includes one or more sub-array antenna independently connected to a power supply line and each sub-array antenna includes one or more unit element antenna. In the active channel portion, the switches are separately arranged to the power supply line, the transmission and receiving channels are connected to the switches to perform amplification and phase control of signal power, and the signal combiner and splitter combines and splits signal power that is input to and output from the transmission and receiving channels. The control portion of the modem and control portion electrically and mechanically controls the array antennas and the modem modulates/demodulates a transceiving signal.

The multi-mode antenna is capable of changing to a transmission use, a receiving use, a double use of transmission and receiving, or a non-operation state as the transmission and receiving channel is selected according to the ON or OFF state of the switch. The radiation portion performs beam forming through the change of the beam width and beam pattern shape. The modem and control portion outputs a control signal to the transmission and receiving channels of the active channel portion and controls the strength and phase of signal power output from the transmission and receiving channels to the radiation portion according to the control signal, and the beam pattern shape and beam pattern direction (steering) of the radiation portion are changed through the strength and phase control of the signal power.

The array antennas are changeable to antennas of a variety of modes by changing an area in operation through the switches. The variety of modes is any one of an element antenna mode, a sub-array antenna mode, an array antenna mode, a multiple array antenna mode, and an MIMO (multiple input multiple output) antenna mode.

The sub-array antenna mode is formed of a combination of the element antenna mode, the array antenna mode is formed of a combination of the sub-array antenna mode, the multiple array antenna mode is formed of a combination of the array antenna mode, and the MIMO antenna mode is formed of two or more array antenna modes that are independent of each other. The radiation portion includes two or more array antennas, and the multi-mode antenna has a multiple array antenna mode in which beam patterns radiated by the array antennas are combined or an MIMO antenna mode in which the beam patterns are not combined and independently maintained by adjusting the distance between the adjacent array antennas using a mechanical or electrical control method by the control portion.

The multi-mode antenna is selectively operated in a plurality of frequency bands. The multi-mode antenna is operated in a selected specific frequency as the unit element antennas or the sub-array antennas of the array antenna are controlled through the model and control portion and the transmission and receiving channels. For control and selection of a variety of modes, the multi-mode antenna performs a frequency selection according to an operation frequency setting, an antenna structure selection to select any one of an element antenna mode, a sub-array antenna mode, an array antenna mode, a multiple array antenna mode, and an MIMO antenna mode, and a frequency range selection to control a beam pattern steering direction, a beam width, and beam forming. The multi-mode antenna includes a command system or an operation program to process the control and selection of the mode.

According to another aspect of the present invention, a method of controlling a mode of a multi-mode antenna including a radiation portion having one or more array antenna, an active channel portion connected to the array antenna, and a modem and control portion connected to the active channel portion, comprises setting an antenna mode, making a frequency multi-mode, and changing to an array antenna structure of the radiation portion corresponding to the set antenna mode.

In the setting of an antenna mode, if the set antenna mode cannot be accommodated by the multi-mode antenna, the antenna mode is reset and, if the set antenna mode can be accommodated by the multi-mode antenna, the frequency multi-mode is performed.

The making of the frequency multi-mode comprises giving an operation frequency reconfiguration command, and reconfiguring a frequency of the radiation portion and active channel portion according to the reconfiguration command.

The array antenna includes one or more sub-array antenna independently connected to a power supply line, the sub-array antenna includes one or more unit element antenna, the active channel portion includes a switch separately arranged at the power supply line, and in the changing of an array antenna structure, the antenna structure is selected and changed to any one of an element antenna mode, an array antenna mode, a multiple array antenna mode, and an MIMO antenna mode.

The changing of an array antenna structure comprises giving an antenna reconfiguration command to any one of the element antenna mode, the array antenna mode, the multiple array antenna mode, and the MIMO antenna mode, and changing an antenna mode of the radiation portion to any one of the element antenna mode, the array antenna mode, the multiple array antenna mode, and the MIMO antenna mode through the switch according to the reconfiguration command.

If the antenna mode is any one of the array antenna mode, the multiple array antenna mode, and the MIMO antenna mode, a frequency range selection operation is performed after the array antenna structure selection operation, and the frequency range selection operation comprises giving an antenna reconfiguration command for a radio wave range control, and controlling a beam steering and beam width of the multi-mode antenna according to the reconfiguration command.

Advantageous Effects

According to the multi-mode antenna and controlling method thereof according to the present invention, the steering direction and width of a beam pattern radiated from a plurality of the array antennas can be diversely changed according to an antenna mode requested through the active channel unit and the modem and control unit.

Also, by constructing each of the array antennas to include sub-array antennas independently connected to a power supply line, the steering direction and width of a beam pattern of the array antenna can be diversely controlled. Accordingly, the steering direction and width of a beam pattern of the overall multimode antenna including a plurality of the array antennas can be more diversely changed.

Therefore, by means of the above-described mode changing characteristic, the multimode antenna can adaptively cope with a change in a fast changing communication environment. Also, a base station and a repeater antenna having an economic and high performance transmitting and receiving function can be implemented.

DESCRIPTION OF DRAWINGS

The above and other features and advantages of the present invention will become more apparent by describing in detail embodiments thereof with reference to the attached drawings in which.

BEST MODE

Figure 1:
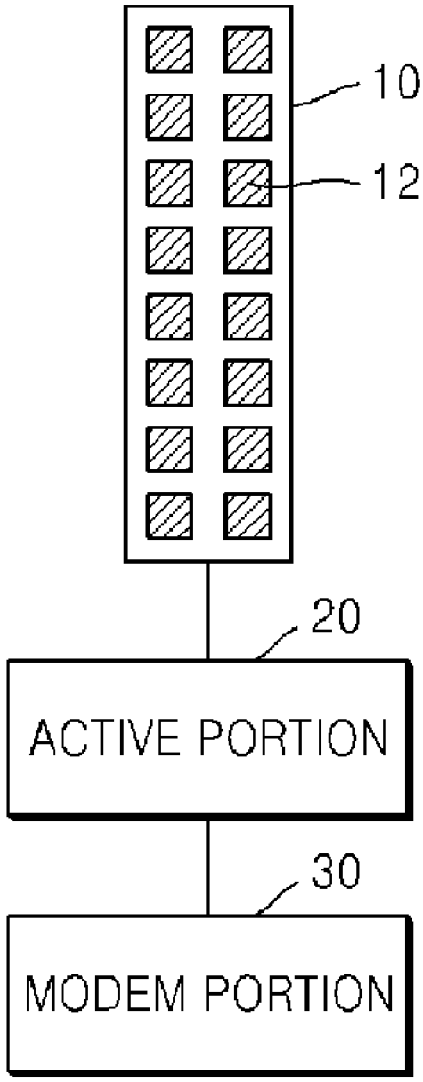
FIG. 1 illustrates the structure of a conventional base station antenna.

The structure and operating mode concept of a multi-mode antenna according to an embodiment of the present invention will now be described in detail with reference to the accompanying drawings. In each drawing, the size and shape of constituent elements are exaggerated for the convenience and clarity of explanation and portions that are not related to the description are omitted. In the drawings, like reference numerals denote like elements. For the convenience of explanation of the present invention, the constituent elements forming a multi-mode antenna are defined as follows. First, a basic unit of a multi-mode antenna is an array antenna and the multi-mode antenna of the present invention includes at least one array antenna. To distinguish a multi-mode antenna from other antennas, a multi-mode antenna refers to an antenna having a plurality of array antennas. Each of the array antennas includes one or more sub-array antennas each of which includes an element antenna that is the minimum basic unit of the antenna. In the present invention, the sub-array antenna has an independent power supply line connected to an active channel unit and the operation of the sub-array antenna can be independently controlled by means of a switch connected to each power supply line.

Figure 2:
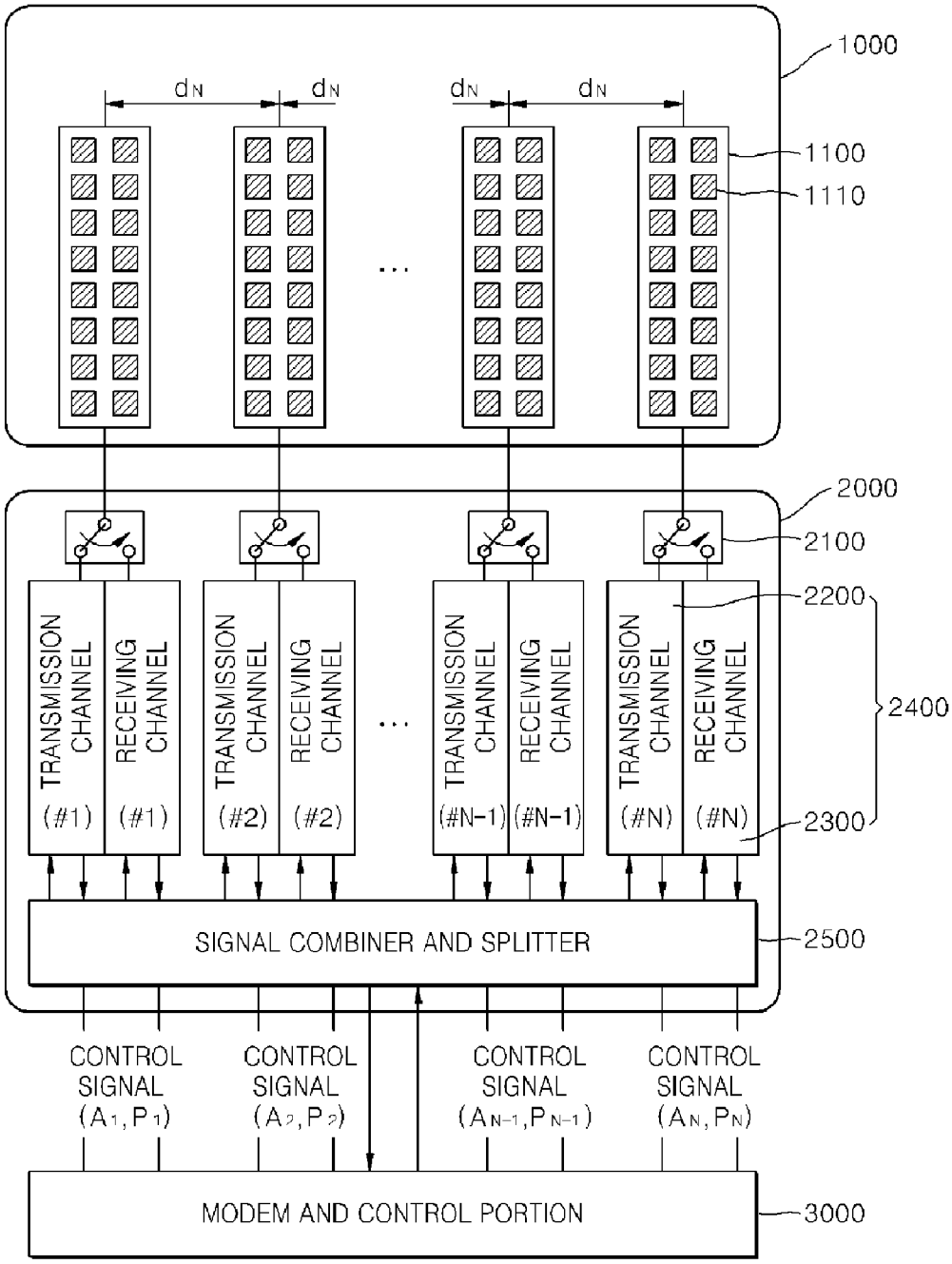
FIG. 2 illustrates the structure of a multi-mode antenna according to an embodiment of the present invention.

FIG. 2 illustrates the structure of a multi-mode antenna according to an embodiment of the present invention. The multi-mode antenna according to the present embodiment includes a radiation unit 1000 having at least one array antenna 1100, an active channel unit 2000 connected to the radiation unit 1000, and a modem and control unit 3000 connected to the active channel unit 2000. Here, each of the array antennas 1100 comprises a plurality of element antennas 1110. The radiation unit 1000 performs a function of receiving or transmitting signal power through a free space.

The active channel unit 2000 includes a plurality of switches 2100, a plurality of transceiving channels 2400 each having a transmission channel 2200 and a receiving channel 2300, and a signal combiner and splitter 2500. Each of the switches 2100 selects either the transmission channel 2200 or the receiving channel 2300 that are connected to each of the array antennas 1100. Thus, the array antennas 1100 are switched to either a transmission mode or a receiving mode according to the operations of the switches 2100. When the switches 2100 are not connected to either the transmission channels 2200 or the receiving channels 2300, the array antennas 1100 are not used for any purposes and remain in a standby mode.

The transmission channel 2200 and the receiving channel 2300 each perform functions of amplification and phase control of transmitted and received signal power. The magnitude and phase of the signal power output from each of the transmission channel 2200 and the receiving channel 2300 are controlled according to a control signal $A_N$, $P_N$ transmitted from the modem and control unit 3000. The signal combiner and splitter 2500 performs a splitting function to split transmission signal power output from the modem and control unit 3000 to a plurality of the transmission channels 2200 and a combination function to combine receiving signal power output from a plurality of the receiving channels 2300.

The modem and control unit 3000 includes a control unit (not shown) and a modem (not shown). The control unit, as described above, electrically and mechanically controls the multi-mode antenna including performing magnitude and phase control of a signal at the transmission channel 2200 and the receiving channel 2300. The modem performs a modulation/demodulation function of a transmission and receiving signal. Also, the modem and control unit 3000 controls a physical distance $d_N$ between adjacent array antennas 1100 so as to switch the multi-mode antenna between a multiple array antenna operating mode (please refer to the descriptions of FIGS. 5, 6, and 10) and a multiple input multiple output (MIMO) antenna operating mode (please refer to the descriptions of FIGS. 7 and 11).

Figure 3:
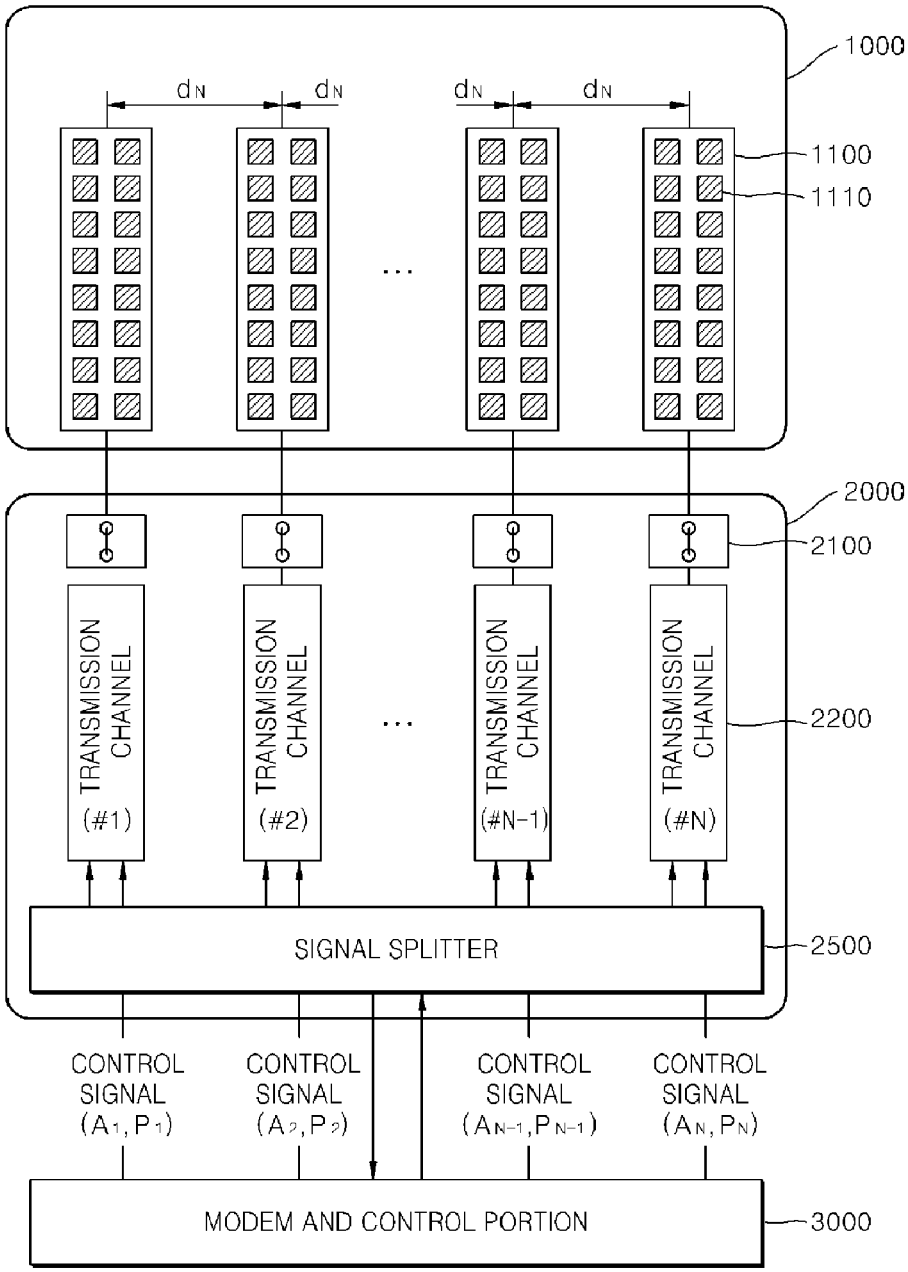
FIG. 3 illustrates the structure of the multi-mode antenna of FIG. 2 in a transmission operating mode, according to an embodiment of the present invention.

FIG. 3 illustrates the structure of the multi-mode antenna of FIG. 2 in a transmission operating mode, according to an embodiment of the present invention. Referring to FIG. 3, the multi-mode antenna according to the current embodiment of the present invention has a variable structure capable of switching between a double use of transmission and receiving and an exclusive use of transmission or receiving according to the structure of the active channel unit 2000. That is, by connecting the switches 2100 of the active channel unit 2000 to the transmission channels 2200 or the receiving channels 2300, the multi-mode antenna can be configured for transmission exclusively or receiving exclusively. Also, the multi-mode antenna can be configured for both transmission and receiving purposes. In FIG. 3, the receiving channels 2300 are omitted for the convenience of explanation. That is, each of the receiving channels 2300 may be located at a side of each of the transmission channels 2200 as in FIG. 2.

Figure 4:
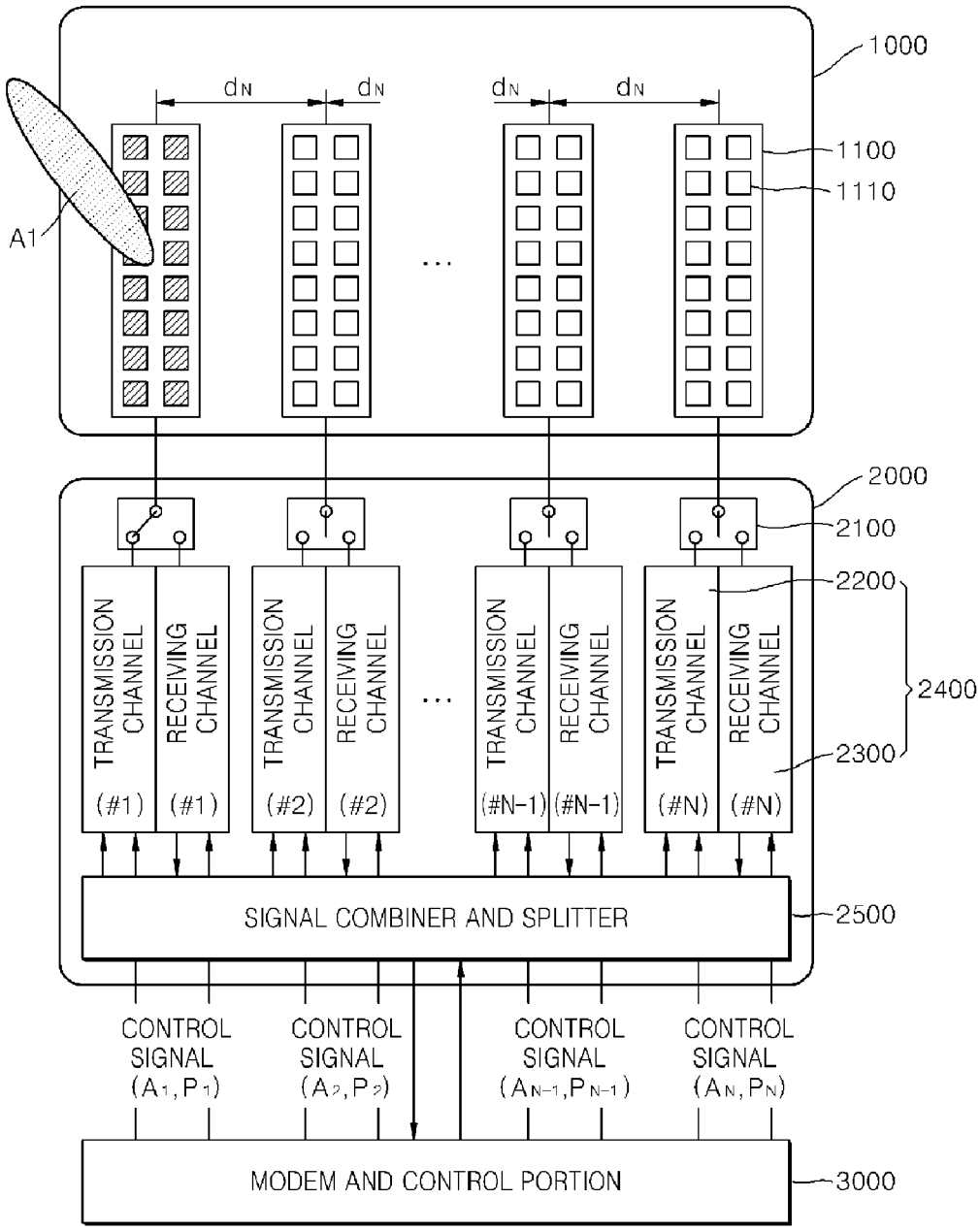
FIG. 4 illustrates the structure of the multi-mode antenna of FIG. 2 in a single array antenna operating mode, according to another embodiment of the present invention.

FIG. 4 illustrates the structure of the multi-mode antenna of FIG. 2 in a single array antenna operating mode, according to another embodiment of the present invention. Referring to FIG. 4, in the single array antenna operating mode of the present embodiment, the multi-mode antenna connects only one of the switches 2100 to the corresponding single array antenna 1100, so that only the single array antenna 1100 can transmit or receive a predetermined beam pattern A1. In the following description, a mode in which only one array antenna is used is referred to as a single array antenna operating mode. The single array antenna operating mode is advantageous in that a communication service can be supplied to a narrow area. The multi-mode antenna of the present invention can be selectively used as a single array antenna according to the control of the switches 2100.

Hereinafter, the multi-mode array antenna of the present invention can be configured such that a plurality of the array antennas 1100 constituting the multi-mode antenna are operated together unlike the operating mode of FIG. 4. Also, as the distance $d_N$ between adjacent array antennas 1100 is reduced below a predetermined value, a beam pattern radiated from each of the array antennas 1100 can be combined. In the following description, for convenience of explanation, the distance between the array antennas 1100 is less than a predetermined value at which the multi-mode antenna operating mode can be formed is indicated as $d_1$ and a distance greater than a predetermined value at which each of the array antennas 1100 can be independently operated as the beam patterns radiated from the array antennas 110 are not combined is indicated as $d_2$.

Figure 5:
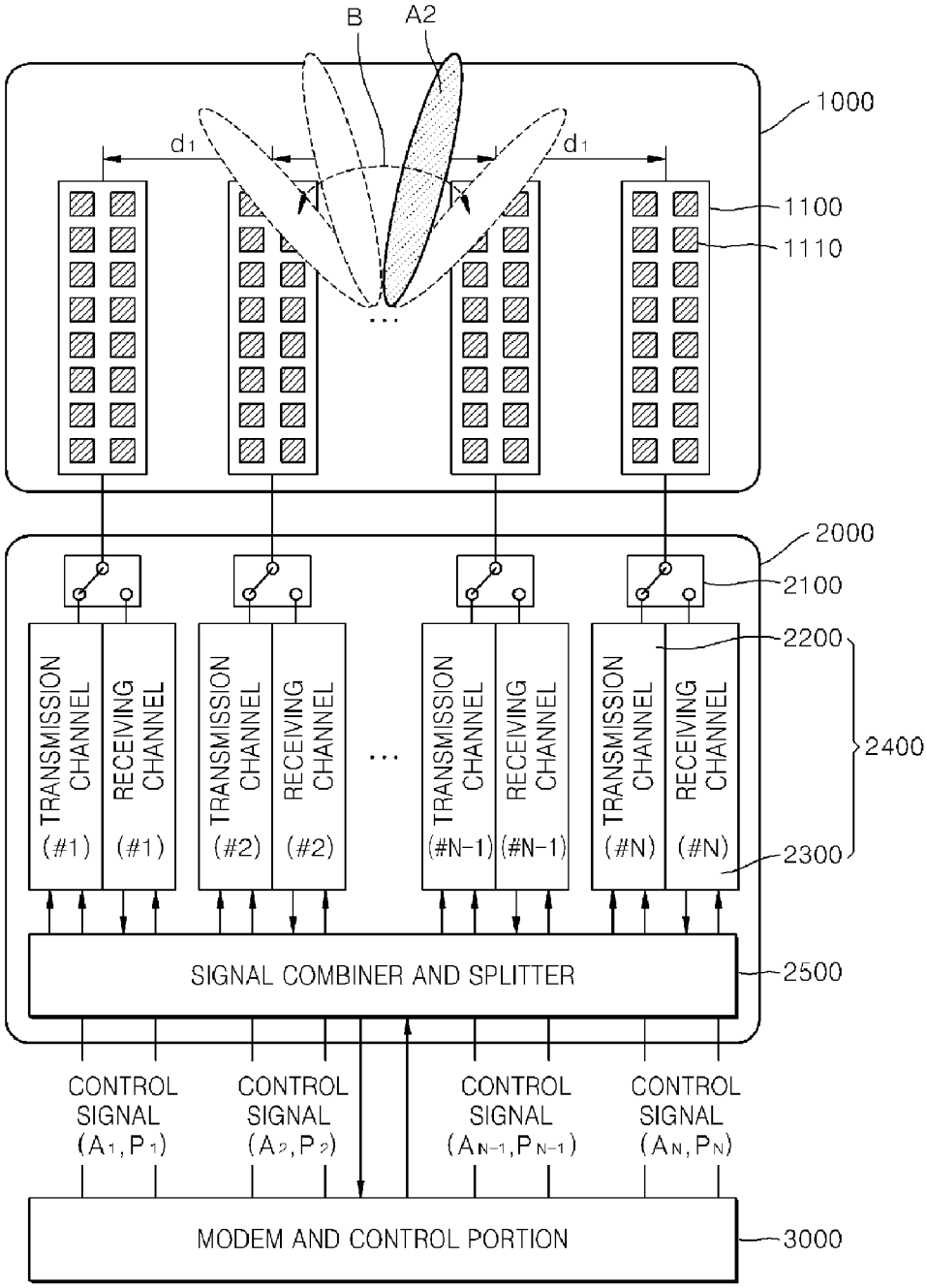
FIG. 5 illustrates the structure of the multi-mode antenna of FIG. 2 in a multiple array antenna operating mode performing a beam steering control function, according to another embodiment of the present invention.

FIG. 5 illustrates the structure of the multi-mode antenna of FIG. 2 in a multiple array antenna operating mode performing a beam steering control function, according to another embodiment of the present invention. Referring to FIG. 5, unlike FIG. 4, the multi-mode antenna according to the present embodiment is configured in a multiple array antenna operating mode in which a plurality of the array antennas 1100 constituting the multi-mode antenna are operated together, and can perform a beam steering control function. That is, the strength of the signal power output from each of the transmission channels 2200 is made identical through the control signal $A_N$, $P_N$ output from the modem and control unit 3000. A beam pattern of the multi-mode antenna is generated as a combined beam pattern A2 in which the beam patterns of the array antennas 1100 are combined together. Also, the steering direction of the combined beam pattern A2 can be changed as indicated by an arrow B through a method of controlling only the phase of the signal power.

Figure 6:
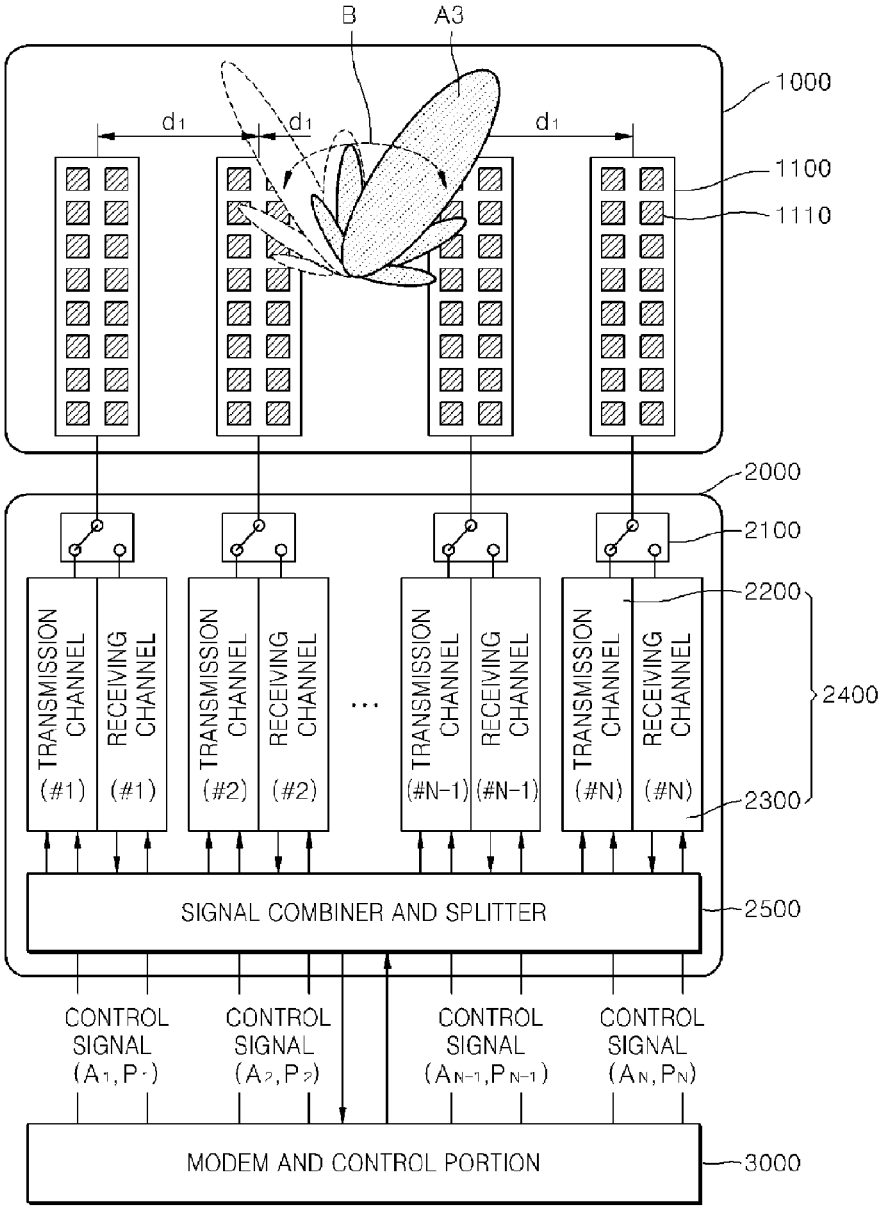
FIG. 6 illustrates the structure of the multi-mode antenna of FIG. 2 in a multiple array antenna operating mode performing a beam steering control and beam forming function, according to another embodiment of the present invention.

FIG. 6 illustrates the structure of the multi-mode antenna of FIG. 2 in a multiple array antenna operating mode performing a beam steering control and beam forming function, according to another embodiment of the present invention. Referring to FIG. 6, in the present embodiment, the multi-mode antenna performs not only the beam steering control of FIG. 5 but also a beam forming function. That is, a service area and a signal transceiving direction can be simultaneously controlled by selectively varying not only the steering direction of a combined beam pattern A3 but also the beam width through a method of simultaneously controlling the strength and phase of the signal power output from each of the transmission channels 2200, according to the control signal $A_N$, $P_N$ output from the modem and control unit 3000.

The structure of the multi-mode antenna of the present embodiment has all the functional characteristics described in FIG. 5 and facilitates an operational convenience, for example, a selective or simultaneous operation of the beam steering control and beam width control functions.

Figure 7:
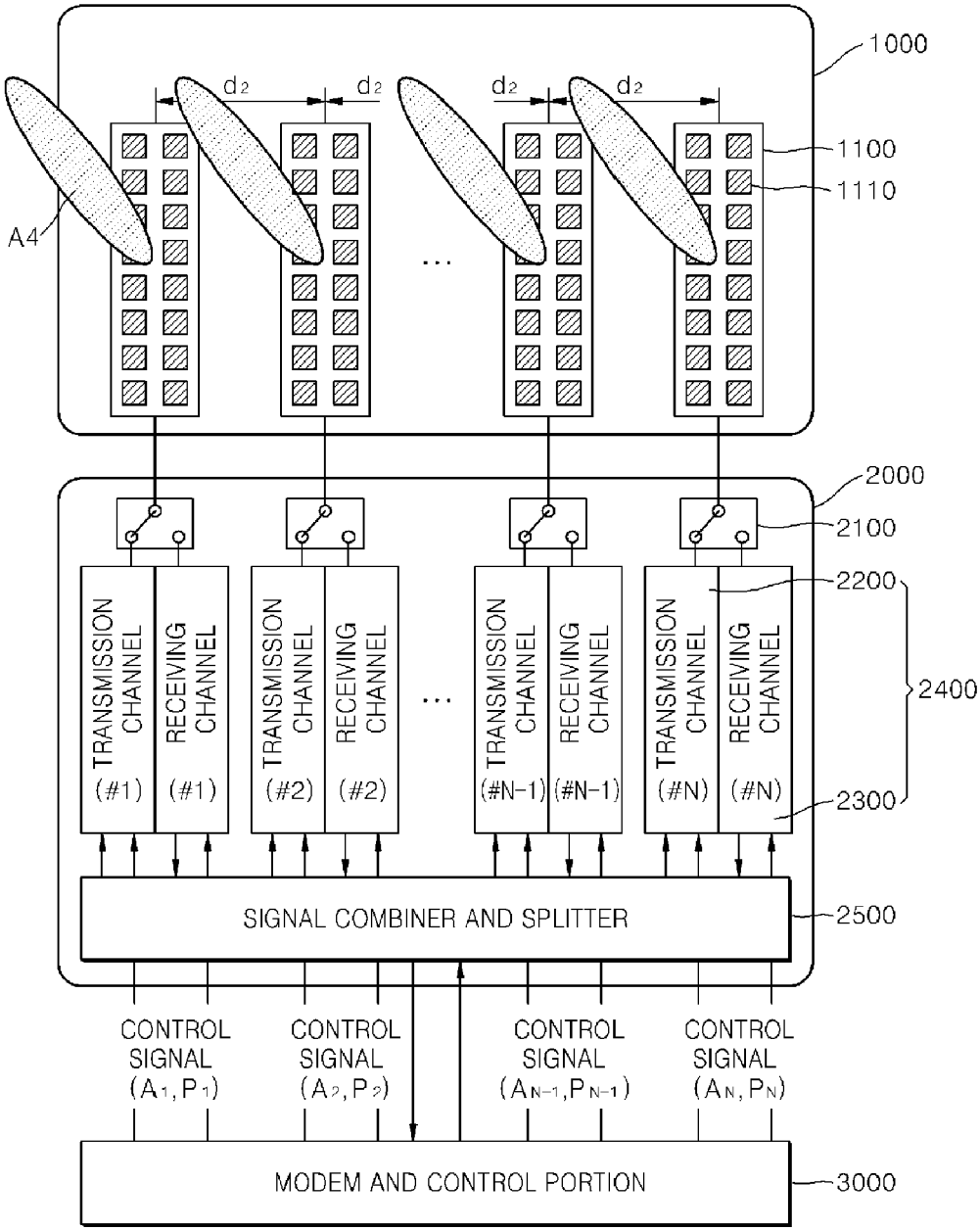
FIG. 7 illustrates the structure of the multi-mode antenna of FIG. 2 in a multiple input multiple output (MIMO) antenna operating mode, according to another embodiment of the present invention.

FIG. 7 illustrates the structure of the multi-mode antenna of FIG. 2 in an MIMO antenna operating mode, according to another embodiment of the present invention. Referring to FIG. 7, in the present embodiment, each of the array antennas 1100 has an independent beam pattern A4, suitable for the next generation communication environment, and simultaneously transmits and receives an individual signal or the same signal, so that the performance of restoration of a signal is improved and communication quality is improved. In the MIMO antenna operating mode according to the present embodiment, the independent beam patterns A4 radiated from the array antennas 1100 are not combined and maintained independently. To maintain the independent beam patterns A4, as described above, the distance between adjacent array antennas 1100 can be maintained to be greater than a predetermined value. Referring to FIG. 7, the distance between the array antennas 1100 is indicated as $d_2$.

Figure 8:
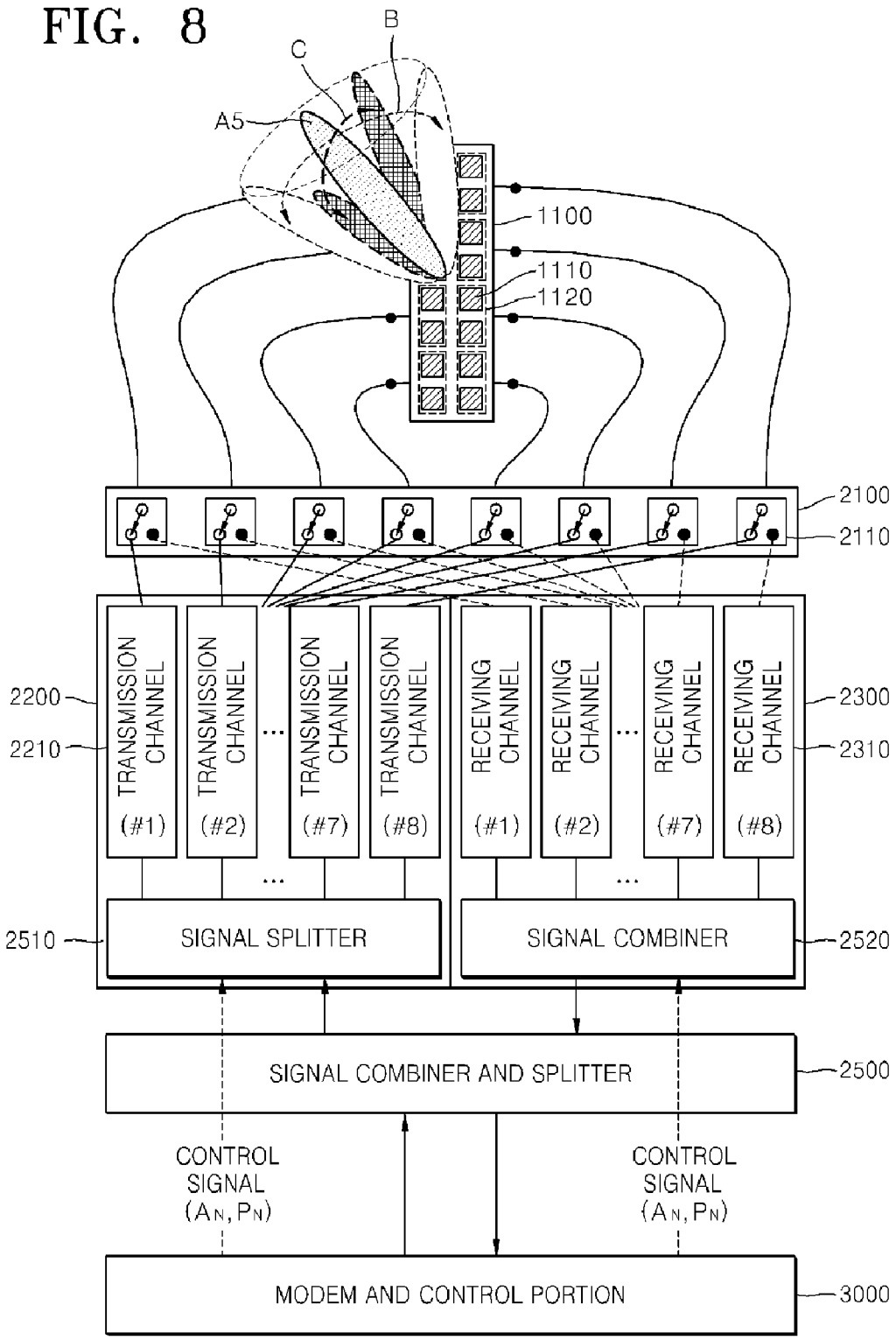
FIG. 8 illustrates the structure of a multi-mode antenna formed of a plurality of sub-array antennas, according to another embodiment of the present invention.

FIG. 8 illustrates the structure of a multi-mode antenna, according to another embodiment of the present invention. Referring to FIG. 8, the multi-mode antenna of the present embodiment includes an array antenna 1100 including a plurality of sub-array antennas 1120, each having an independent power supply line. The structure of each of the sub-array antennas 1120 can be freely determined according to the specification of the antenna. That is, although each of the sub-array antennas 1120 is illustrated to have two element antennas 1110 in FIG. 8, the present invention is not limited thereto, and each of the sub-array antennas 1120 can have a variety of numbers of element antennas and structures as necessary. In FIG. 8, the other array antennas 1100 are omitted for the convenience of explanation.

Also, each of the sub-array antennas 1120 is connected to an independent sub-array antenna switch 2110 (hereinafter, referred to as a sub-switch) of a switch unit 2100 and can be selectively connected to an independent transmission channel 2210 and an independent receiving channel 2310 according to the operation of the corresponding sub-switch 2110. Thus, unlike the structures of the embodiments illustrated in FIGS. 2-7, the steering control of the beam pattern A5 and the beam width control of the single array antenna 1100 can be independently performed through the control of a signal strength $A_N$ and phase $P_N$ of each of the transmission channels 2200 and the receiving channels 2300 via a modem and control unit 3000 and through selection of the transmission and receiving functions through the control of the sub-switches 2110. A signal splitter 2510 splits transmission signal power output from the modem and control unit 3000 to distribute the split transmission signal power to the multiple transmission channels 2210. A signal combiner 2520 combines receiving signal power output from the plurality of receiving channels 2310.

That is, although in a conventional array antenna, transmission channels and receiving channels are connected to a single array antenna so that the steering or width of a beam pattern of the array antenna is fixed, in the present embodiment, the array antenna 1100 includes the sub-array antennas 1120 each having an independent power supply line so that the steering or width of the beam pattern A5 of the array antenna 1100 can be controlled.

As described above, although in FIG. 8 only one array antenna 1100 having the sub-array antennas 1120 is shown, two or more array antennas 1100 including the sub-array antennas 1120 can be provided as a radiation unit like the radiation unit 1000. In FIG. 8, 'B' and 'C' respectively denote the azimuthal angle and wave angle of the beam pattern steering.

Figure 9:
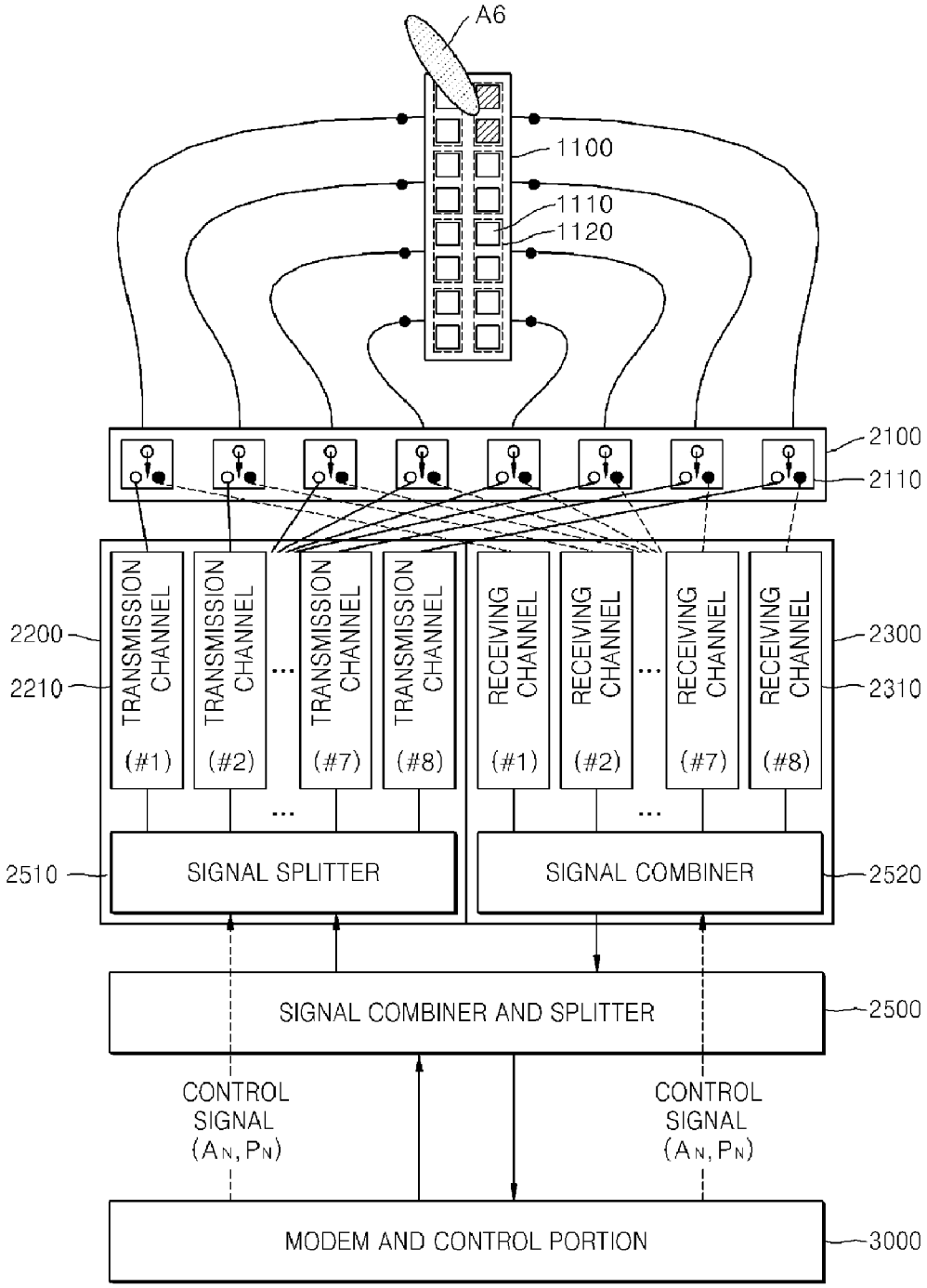
FIG. 9 illustrates the structure of the multi-mode antenna of FIG. 8 in a single sub-array antenna operating mode, according to an embodiment of the present invention.

FIG. 9 illustrates the structure of the multi-mode antenna of FIG. 8 in a single sub-array antenna operating mode, according to an embodiment of the present invention. Referring to FIG. 9, in the present embodiment, as described above, the multi-mode antenna has the structural characteristic of independently controlling the operation of each of the sub-array antennas 1120, by which even only one of the sub-array antennas 1120 can be operated. That is, in the present embodiment, the multi-mode function of the array antenna 1100 can be applied to the level of the single sub-array antenna 1120. Furthermore, unlike the present embodiment, the minimum level of the antenna multi-mode can be reduced to the element antenna 1110 according to the requirements of the multi-mode antenna.

Figure 10:
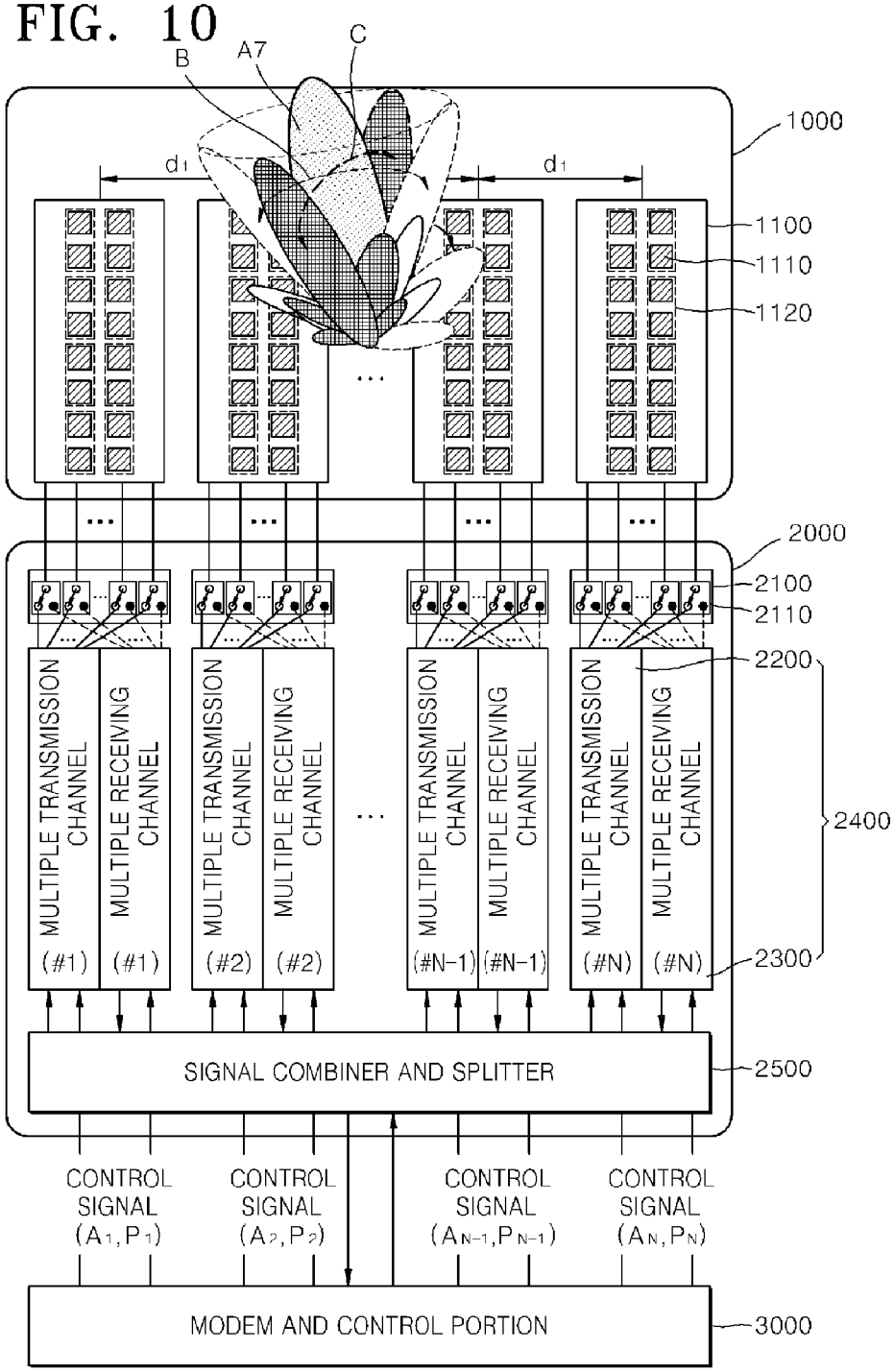
FIG. 10 illustrates the structure of a multi-mode antenna in a multiple array antenna operating mode performing a beam steering control and beam forming function, according to another embodiment of the present invention.

FIG. 10 illustrates the structure of a multi-mode antenna in a multiple array antenna operating mode performing a beam steering control and beam forming function, according to another embodiment of the present invention. Referring to FIG. 10, in the multiple array antenna operating mode according to the present embodiment, the multi-mode antenna not only combines the beam pattern of each of the array antennas 1100 as shown in FIG. 5 or 6, but also simultaneously performs the beam width control and the beam steering control in the azimuthal angle B and the wave angle direction C with respect to a beam pattern A7 of the multiple array antenna through the signal strength and phase control at a level of the sub-array antenna 1120 using the structural characteristic of the array antenna including the sub-array antennas.

Accordingly, the multi-mode antenna structure of the present embodiment can perform a beam steering and beam forming function more accurately than that of FIGS. 5 and 6 in which the minimum unit of the signal strength and phase control is the array antenna 1100.

Figure 11:
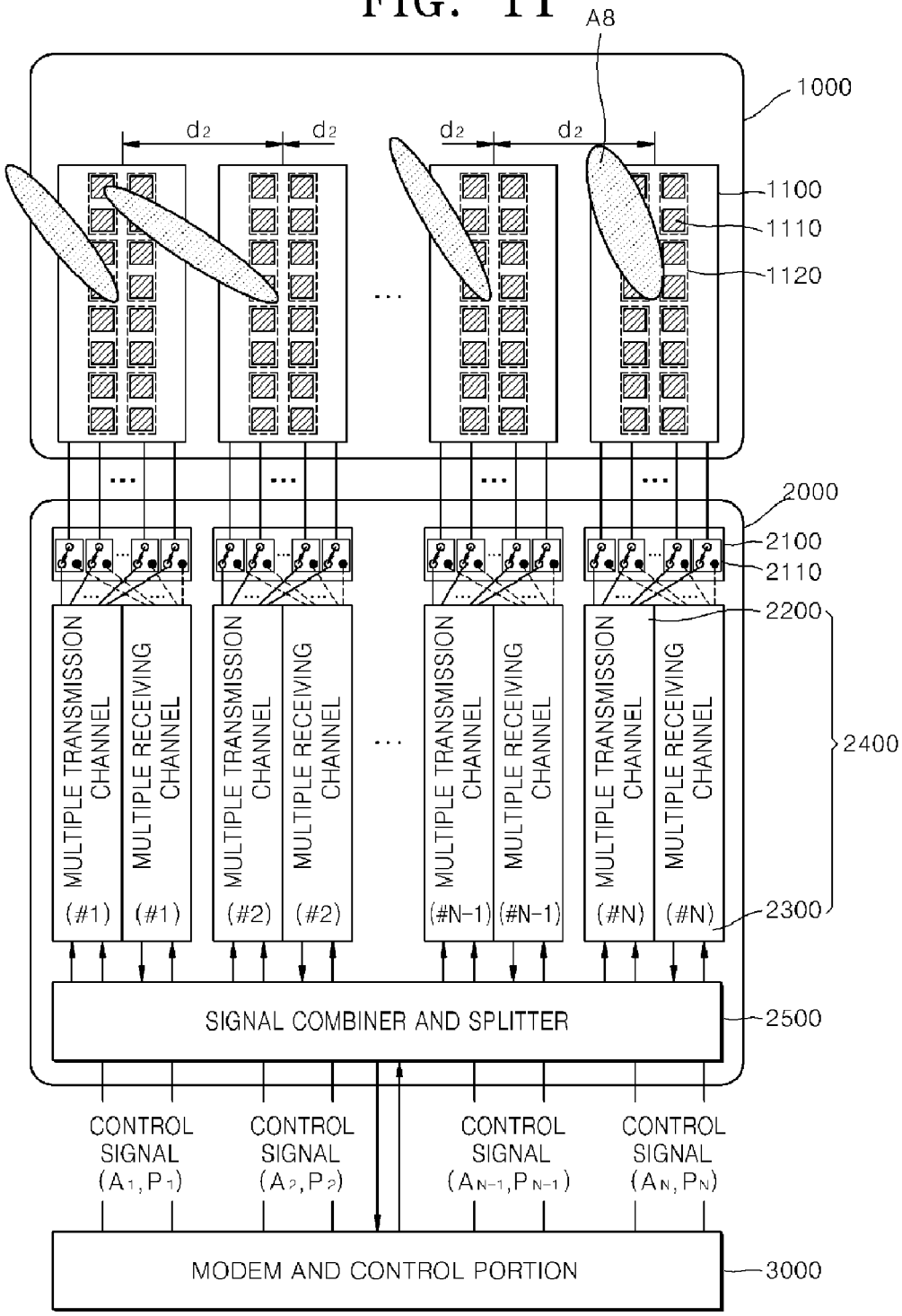
FIG. 11 illustrates the structure of the multi-mode antenna of FIG. 8 in a MIMO antenna operating mode, according to another embodiment of the present invention.

FIG. 11 illustrates the structure of the multi-mode antenna of FIG. 10 in an MIMO antenna operating mode, according to another embodiment of the present invention. Referring to FIG. 11, in the MIMO operating mode of the present embodiment, like the structure of FIG. 7, the multi-mode antenna is configured such that the plurality of array antennas 1100 are spaced apart from each other by a predetermined distance d2 to maintain an independent beam pattern A8. However, unlike the structure of FIG. 7, the beam pattern A8 of each array antenna 1100 can be independently changed through a signal strength and phase control at the level of the sub-array antennas 1120. Thus, according to the multi-mode antenna structure of the present embodiment, in addition to the above-described general MIMO antenna function, a communication service can be provided to a plurality of areas by controlling the beam width or steering the beam pattern A8 of each of the array antennas 1100 in different directions.

Figure 12:
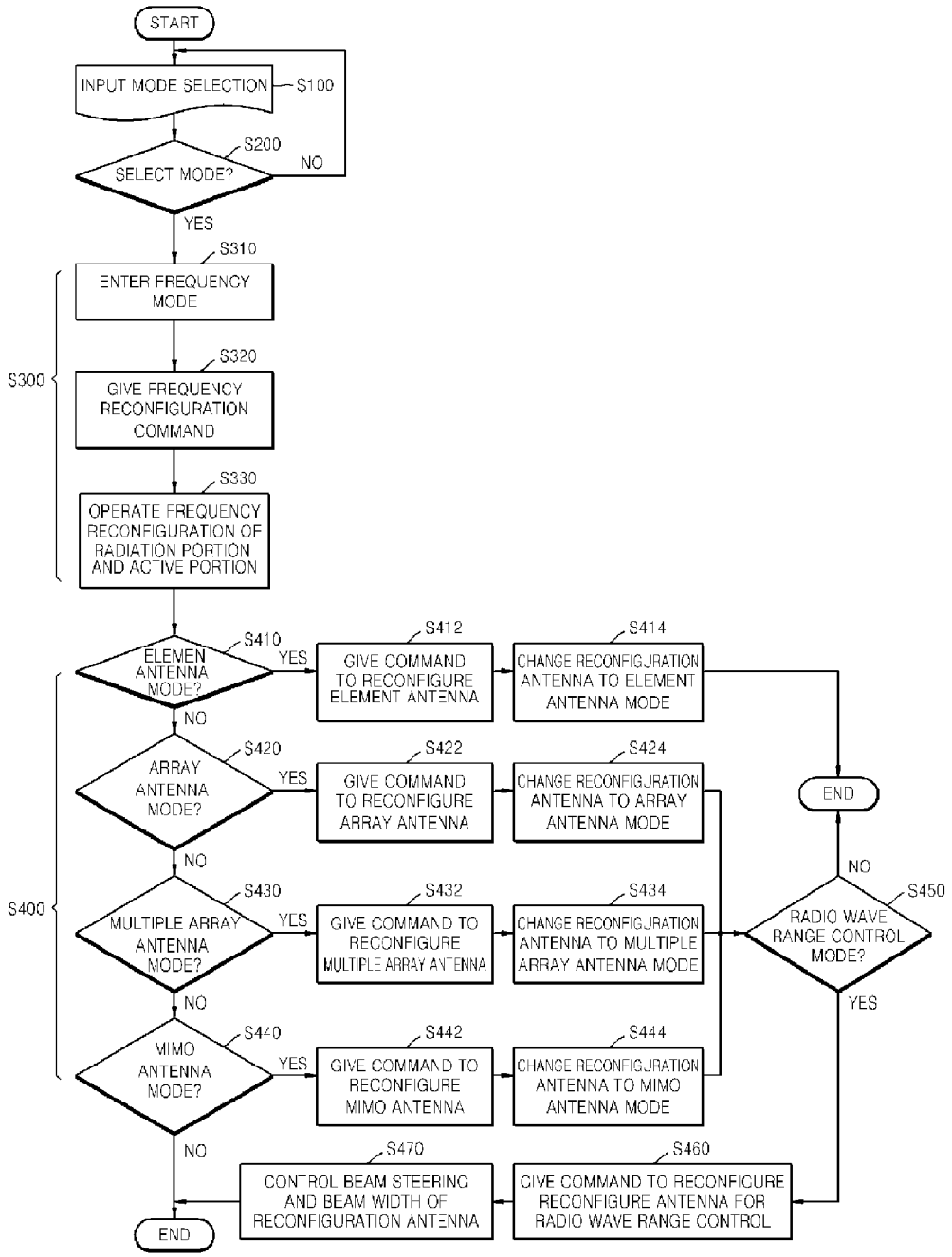
FIG. 12 is a flowchart for explaining a method of controlling the operating mode changing of the multi-mode antenna of FIG. 2 or FIG. 8, according to an embodiment of the present invention.

FIG. 12 is a flowchart for explaining a method of controlling the changing of operating modes of the multi-mode antenna of FIG. 2 or FIG. 8 according to an embodiment of the present invention. In the present embodiment, it is assumed that the multi-mode antenna has a frequency multi-mode function by which the element antennas 1110 that are the minimum constituent units and other parts such as the transmission channel 2200 and the receiving channel 2300 can be selectively operated in multiple bands through the control of the modem and control unit 3000.

Referring to FIG. 12, in the method of controlling a multi-mode antenna of the present embodiment, first, the structural mode of the multi-mode antenna is input to control the operation of the multi-mode antenna in a mode selection input operation (S100). Next, it is determined whether a mode is selected in a mode selection operation (S200). In the mode selection operation (S200), it is also determined whether the selected mode can be accommodated by the multi-mode antenna. In other words, as soon as the operation command of the multi-mode antenna, that is, a mode selection, is input, it is determined whether the multi-mode antenna can accommodate the operation command. When the operation command can be accommodated, the process goes to an initial frequency multi-mode operation (S300). When the operation command cannot be accommodated, the process returns to the mode selection input operation (S100).

In the frequency multi-mode operation (S300), the radiation unit 1000 and the active channel unit 2000 enter a frequency multi-mode so that the multi-mode antenna can be normally operated at an input frequency. The frequency multi-mode operation (S300) includes a frequency mode operation (S310), a frequency reconfiguration command (S320), and a radiation portion and active portion reconfiguration operation (S330). In the frequency mode operation (S310), the frequency multi-mode (S300) starts. In the frequency reconfiguration command operation (S320), a command for the frequency multi-mode is given. According to the command, the radiation portion 1000 and the active channel unit 2000 enter a multi-mode to be operated at a predetermined frequency in the radiation portion and active portion reconfiguration operation (S330). As soon as the multi-mode is completed, the flow of the command for the frequency multi-mode is terminated.

After the frequency multi-mode operation (S300) is completed, a control for each mode is performed according to the type of a mode input in an antenna mode determination operation (S400). The antenna mode determination operation (S400) is described below in detail.

In an element antenna mode determination operation (S410), it is determined whether a selected and input mode is an element antenna mode and, if so, an element antenna reconfiguration command operation (S412) is performed. As described with reference to FIG. 9, a command is given to operate only the element antenna 1110 or the sub-array antenna 1120 that is the minimum unit of the array antenna. According to the command, in a reconfiguration antenna's element antenna mode switch operation (S414), only one of the element antenna 1110 or the sub-array antenna 1120 of the multi-mode antenna is operated through the operation control of the sub-switch 2110 connected to the sub-array antenna 1120 as shown in FIG. 9. A changing process of making the multi-mode antenna become the element antenna mode through the above process is completed.

In an array antenna mode determination operation (S420), it is determined whether the selected and input mode is the array antenna mode. If so, only one array antenna is operated as shown in FIG. 4 through an array antenna reconfiguration command operation (S422) and a reconfiguration antenna's element antenna mode switch operation (S424) as in the above-described element antenna mode.

When the array antenna mode is selected and input and the switch to the array antenna mode is completed through the above-described processes, a radio wave range control mode determination operation (S450) is performed. In the radio wave range control mode determination operation (S450), it is determined whether to control a communication service availability range through the beam steering and beam width control in the selected and input mode. When the communication service availability range control is needed, a multiple mode command to control the radio wave range is given according to the level required in a radio wave range control antenna reconfiguration operation (S460). According to the command, in a reconfiguration antenna's beam steering and beam width control operation (S470), the model and control unit 3000 outputs the control signal $A_N$, $P_N$ to the transmission channel 2200 and the receiving channel 2300 so that the communication service availability range is controlled through the beam steering and beam width control. In contrast, when the communication service availability range control is not necessary, the flow of a mode command is terminated at once.

In a multi-array antenna mode determination operation (S430), it is determined whether the selected and input mode is a multiple array antenna mode. In the multiple array antenna mode, similarly to the above-described array antenna mode, the radiated beam patterns are combined by adjusting the distance between the array antennas within a predetermined level, as described with reference to FIGS. 5, 6, and 10, through a multiple array antenna reconfiguration command operation (S432) and a reconfiguration antenna's multiple array antenna mode switch operation (S434). In the multiple array antenna mode, when the above-described communication service availability range control is needed, the communication service availability range are controlled through the control of the operations of the modem and control unit 3000 and the active channel unit 2000.

Finally, in an MIMO antenna mode determination operation (S440), it is determined whether the selected input mode is an MIMO antenna mode. When the selected input mode is the MIMO antenna mode, the multi-mode antenna is changed to the MIMO antenna mode as described with reference to FIGS. 7 and 11 through the process such as the array antenna mode or multiple array antenna modes. In a reconfiguration antenna's MIMO antenna mode switch operation (S444), the distance between the array antennas is adjusted to be greater than a predetermined level such that each of the array antennas can radiate an independent beam pattern according to the command in the MIMO antenna reconfiguration command operation (S442).

The above-described method of controlling the operation mode of a multiple mode antenna is an example of the methods of controlling a multi-mode antenna according to the present invention. The present invention is not limited to the above description and a variety of similar mode control methods can be suggested. It must be understood that such variety in the method is within a conceptual range to be protected by the present invention.

While this invention has been particularly shown and described with reference to preferred embodiments thereof, it will be understood by those skilled in the art that various changes in form and details may be made therein without departing from the spirit and scope of the invention as defined by the appended claims.

Industrial Applicability

The present invention relates to an antenna, and more particularly, to a reconstructed antenna for a base station and a repeater used for mobile communications. According to the multi-mode antenna and controlling method thereof according to the present invention, the steering direction and width of a beam pattern radiated from a plurality of the array antennas can be diversely changed according to an antenna mode requested through the active channel unit and the modem and control unit.

The invention claimed is:

1. A multi-mode antenna comprising:

power supply lines;

a radiation unit having one or more array antennas that have an antenna effective opening surface and a direction of an antenna beam pattern, the radiation unit being capable of selectively changing the antenna effective opening surface and changing the direction, wherein each of the array antennas comprises one or more sub-array antennas that are each independently connected to a respective one of the power supply lines and each sub-array antenna comprises one or more unit element antennas;

an active channel unit connected to the one or more array antennas of the radiation unit, the active channel unit including a plurality of switches, a plurality of transmission channels, a plurality of receiving channels, and a signal combiner and splitter; and a modem and control unit connected to the active channel unit and having a control unit and a modem, wherein in the active channel unit, the switches are separately arranged to the power supply lines, the transmission and receiving channels are connected to the switches to perform amplification and phase control of signal power of one or more signals that are then output therefrom, and the signal combiner and splitter combines and splits signal power of one or more signals for being input to or one or more of the signals that are output from the transmission and receiving channels, and the control unit electrically and mechanically controls the array antennas and the modem modulates/demodulates a transceiving signal.

2. The multi-mode antenna of claim 1, wherein the multi-mode antenna is capable of changing to a transmission mode, a receiving mode, a double mode of transmission and receiving, or a non-operating mode based on one or more of the transmission channels and the receiving channels being selected according to the ON or OFF states of the switches.

3. The multi-mode antenna of claim 1, wherein the radiation unit performs beam forming through changing a beam width and beam pattern shape.

4. The multi-mode antenna of claim 3, wherein one or more of the signals that are output from the transmission and receiving channels are output to the radiation unit, further wherein the modem and control unit outputs a control signal to the transmission and receiving channels of the active channel unit and controls the strength and phase of signal power of the one or more of the signals that are output from the transmission and receiving channels to the radiation unit according to the control signal, and the beam pattern shape and beam pattern direction (steering) of the radiation unit are changed through the strength and phase control of the received signal power.

5. The multi-mode antenna of claim 1, wherein the one or more array antennas operate in one of a plurality of modes through adjusting of the switches according to an area in operation.

6. The multi-mode antenna of claim 5, wherein the plurality of modes comprise an element antenna mode, a sub-array antenna mode, an array antenna mode, a multiple array antenna mode, and a multiple input multiple output MIMO antenna mode.

7. The multi-mode antenna of claim 6, wherein the sub-array antenna mode is formed of a combination of element antenna modes, the array antenna mode is formed of a combination of sub-array antenna modes, the multiple array antenna mode is formed of a combination of array antenna modes, and the MIMO antenna mode is formed of two or more array antenna modes that are independent of each other.

8. The multi-mode antenna of claim 7, wherein the radiation unit includes two or more array antennas, and the multi-mode antenna has the multiple array antenna mode, in which beam patterns radiated by the array antennas are combined, or the MIMO antenna mode, in which the beam patterns are not combined and independently maintained, by adjusting the distance between adjacent ones of the array antennas using a mechanical or electrical control method by the control unit.

9. The multi-mode antenna of claim 1, wherein the multi-mode antenna is selectively operated in a plurality of frequency bands.

10. The multi-mode antenna of claim 9, wherein the multi-mode antenna is operated in a selected specific frequency as the one or more unit element antennas or one or more sub-array antennas are controlled through the modem and control unit and the transmission and receiving channels.

11. The multi-mode antenna of claim 9, wherein, for control and selection of a variety of modes, the multi-mode antenna performs a frequency selection according to an operation frequency setting, an antenna structure selection to select any one of an element antenna mode, a sub-array antenna mode, an array antenna mode, a multiple array antenna mode, and an MIMO antenna mode, and a frequency range selection to control a beam pattern steering direction, a beam width, and beam forming.

12. The multi-mode antenna of claim 11, wherein the multi-mode antenna includes a command system or an operation program to process the control and selection of the modes.

13. A method of controlling a mode of a multi-mode antenna including a radiation portion having one or more array antennas, an active channel portion connected to the one or more array antennas, and a modem and control portion connected to the active channel portion, the method comprising:

setting an antenna mode;

entering a frequency multi-mode by giving an operation frequency reconfiguration command; and reconfiguring a frequency of the radiation portion and active channel portion according to the reconfiguration command; and changing the radiation portion to an array antenna structure that corresponds to the set antenna mode.

14. The method of claim 13, wherein, in the setting of an antenna mode, if the set antenna mode cannot be accommodated by the multi-mode antenna, the antenna mode is reset, and if the set antenna mode can be accommodated by the multi-mode antenna, entering the frequency multi-mode is performed.

15. A method of controlling a mode of a multi-mode antenna including a radiation portion having one or more array antennas, an active channel portion connected to the one or more array antennas, and a modem and control portion connected to the active channel portion, wherein the one or more array antennas includes one or more sub-array antennas independently connected to a respective power supply line, each sub-array antenna includes one or more unit element antennas, the active channel portion includes one or more switches separately arranged at the one or more power supply lines, the method comprising:

setting an antenna mode;

entering a frequency multi-mode; and changing the radiation portion to an array antenna structure that corresponds to the set antenna mode, wherein the antenna structure is selected as any one of an element antenna mode, a single array antenna mode, a multiple array antenna mode, and an MIMO antenna mode.

16. The method of claim 15, wherein changing the radiation portion comprises:

giving an antenna reconfiguration command for any one of the element antenna mode, the single array antenna mode, the multiple array antenna mode, and the MIMO antenna mode; and changing an antenna mode of the radiation portion to any one of the element antenna mode, the single array antenna mode, the multiple array antenna mode, and the MIMO antenna mode through the one or more switches according to the reconfiguration command.

17. The method of claim 15, wherein, if the antenna mode is any one of the single array antenna mode, the multiple array antenna mode, and the MIMO antenna mode, a frequency range selection operation is performed after the antenna structure selection operation, and the frequency range selection operation comprises:

giving an antenna reconfiguration command for a radio wave range control; and controlling a beam steering and beam width of the multi-mode antenna according to the reconfiguration command.

* * * * *